US008313097B2

(12) United States Patent
Kayama

(10) Patent No.: US 8,313,097 B2
(45) Date of Patent: Nov. 20, 2012

(54) AUTOMATIC DOCUMENT FEEDER

(75) Inventor: Rumi Kayama, Shizuoka (JP)

(73) Assignee: NEC Access Technica, Ltd., Shizuoka (JP)

( * ) Notice: Subject to any disclaimer, the term of this patent is extended or adjusted under 35 U.S.C. 154(b) by 0 days.

(21) Appl. No.: 13/103,903

(22) Filed: May 9, 2011

(65) Prior Publication Data

US 2012/0013068 A1 Jan. 19, 2012

(30) Foreign Application Priority Data

Jul. 13, 2010 (JP) ..... 2010-158843

(51) Int. Cl.
*B65H 3/06* (2006.01)

(52) U.S. Cl. ..... 271/117

(58) Field of Classification Search ..... 271/114, 271/117, 118, 109, 245, 246, 121
See application file for complete search history.

(56) References Cited

U.S. PATENT DOCUMENTS 6,547,235 B2 * 4/2003 Higaki ..... 271/10.01
7,398,970 B2 * 7/2008 Morimoto et al. ..... 271/117

FOREIGN PATENT DOCUMENTS

JP 2005126202 A 5/2005

* cited by examiner

*Primary Examiner* — Gerald McClain
*Assistant Examiner* — Thomas Morrison

(57) ABSTRACT

An automatic document feeder for automatically feeding a document placed on a document tray includes a paper feed section which includes at least a paper feed roller and a pickup roller and is tilted up and down around a roller shaft of the paper feed roller; and a shutter section including a shutter which is provided on a side plate of the paper feed section, placed at a document restriction position at which a position of the leading edge of the document is restricted before the paper feed section picks up the document, tilted by being pushed by the document to be picked up when the paper feed section picks up the document, and automatically returns to the document restriction position by its own weight after the picked up document has passed under the shutter.

4 Claims, 6 Drawing Sheets

AUTOMATIC DOCUMENT FEEDER

This application is based upon and claims the benefit of priority from Japanese Patent Application No. 2010-158843, filed on Jul. 13, 2010, the disclosure of which is incorporated herein in its entirety by reference.

TECHNICAL FIELD

The present invention relates to an automatic document feeder which automatically feeds a document.

BACKGROUND ART

An automatic document feeder used for a facsimile machine, a copier, a printer device, or the like commonly has a shutter mechanism used for overload protection for a conveying roller, alignment of the leading edge of the document, correction of skewing of the document, double-document feed protection, protection of entry of the document, and the like.

An automatic document feeder with a shutter mechanism is disclosed in Japanese Patent Application Laid-Open No. 2005-126202 as shown in FIG. 7A, FIG. 7B, FIG. 8A, and FIG. 8B. FIG. 7A shows a standby state just before the automatic feeding of the document starts and FIG. 7B shows a pick-up state in which the document is picked up. FIG. 8A shows a state in which a cover of the automatic document feeder is opened and FIG. 8B shows a state in which a cover of the automatic document feeder is closed.

This automatic document feeder includes a shutter 109 which is swingably suspended from a cover 102 and a stopper 117 which is provided on a pick-up arm 107 and restricts the movement of the shutter 109. When the pick-up arm 107 is in the standby state shown in FIG. 7A, the stopper 117 makes contact with a receiving portion 113 provided on the shutter 109. Accordingly, the shutter 109 cannot be tilted to a conveyance path 123 side and whereby a position of a leading edge of a document 124 is restricted when the leading edge of the document 124 is brought into contact with the shutter 109.

In the pick-up state shown in FIG. 7B, the pick-up arm 107 is tilted in a direction to make contact with the document 124. By this, the stopper 117 fixed to the pick-up arm 107 is moved below and the contact of the stopper 117 and the receiving portion 113 is released. Accordingly, the shutter 109 can be tilted to the conveyance path 123 side.

Because a pickup roller 116 is provided at an end portion of the pick-up arm 107 on a document tray 112 side, when the pick-up arm 107 is tilted in the clockwise direction, the pickup roller 116 is brought into contact with the document 124 and the document 124 is fed in the conveyance path 123. The document 124 fed in by the pickup roller 116 pushes a restriction piece 119 to the conveyance path 123 side. Whereby, the restriction piece 119 is tilted in the clockwise direction. When the conveyance of the document 124 ends, the restriction piece 119 hangs down by its own weight and additionally, the pick-up arm 107 returns to the original position. Namely, it returns to the standby state shown in FIG. 7A.

By the way, in such mechanism, there is a possibility that the document 124 is jammed. In such case, as shown in FIG. 8A, the cover 102 is opened and the jammed document 124 is removed. FIG. 8B shows a state in which the cover 102 is closed after removing the jammed document.

The automatic document feeder described in Japanese Patent Application Laid-Open No. 2005-126202 has the following problem. When the cover 102 is opened, the pick-up arm 107 returns to a state in which the pick-up arm 107 is not tilted and the restriction piece 119 returns to a state in which the restriction piece 119 hangs down by its own weight. In a state in which the document is jammed, the restriction piece 119 cannot return to the original state completely but the pick-up arm 107 can return to the original state independently of the document jam. Accordingly, the pick-up arm 107 returns to the original state faster than the restriction piece 119 returns to the original state.

As a result, as shown in FIG. 8B, a state in which the receiving portion 113 is located on a left side and the stopper 117 is located on a right side occurs. As easily understood from the comparison of FIG. 7A and FIG. 8B, a positional relation between the receiving portion 113 and the stopper 117 in FIG. 7A is opposite to a positional relation between the receiving portion 113 and the stopper 117 in FIG. 8B. Hereinafter, a state shown in FIG. 8B in which the receiving portion 113 is located on a left side and the stopper 117 is located on a right side is called a reverse state. In the reverse state, the rotation of the restriction piece 119 in counterclockwise direction is restricted because the receiving portion 113 is brought into contact with the stopper 117. As a result, the restriction piece 119 can rotate only in the clockwise direction.

However, when the restriction piece 119 can rotate in the clockwise direction, the position of the leading edge of the document 124 cannot be restricted. For this reason, in the automatic document feeder disclosed in Japanese Patent Application Laid-Open No. 2005-126202, a control and an operation for changing the position of the stopper 117 and the receiving portion 113 are performed separately. When means for performing such control and operation are added, a problem in which the cost of the automatic document feeder increases occurs.

SUMMARY

A main purpose of the present invention is to provide an automatic document feeder which has a shutter automatically returning to a standby state by its own weight even when the jammed document is removed, in which the above mentioned problem does not occur, and whose price is low.

An automatic document feeder for automatically feeding a document placed on a document tray includes a paper feed section which includes at least a paper feed roller and a pickup roller and is tilted up and down around a roller shaft of the paper feed roller; and a shutter section including a shutter which is provided on a side plate of the paper feed section, placed at a document restriction position at which a position of the leading edge of the document is restricted before the paper feed section picks up the document, tilted by being pushed by the document to be picked up when the paper feed section picks up the document, and automatically returns to the document restriction position by its own weight after the picked up document has passed under the shutter.

BRIEF DESCRIPTION OF THE DRAWINGS

Exemplary features and advantages of the present invention will become apparent from the following detailed description when taken with the accompanying drawings in which.

EXEMPLARY EMBODIMENT

Figure 1:
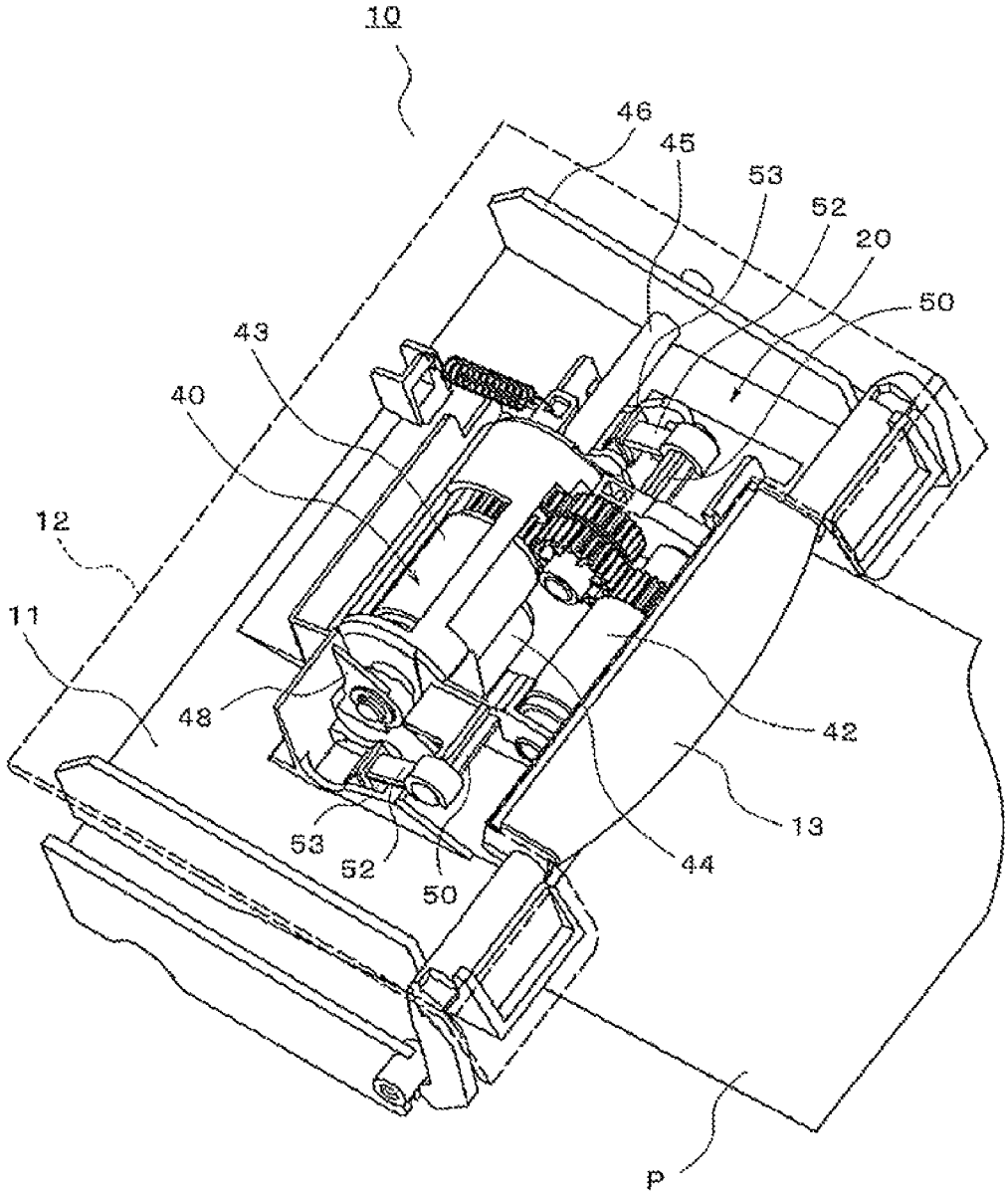
FIG. 1 is a fragmentary perspective view of an automatic document feeder according to an exemplary embodiment of the present invention.
Figure 2:
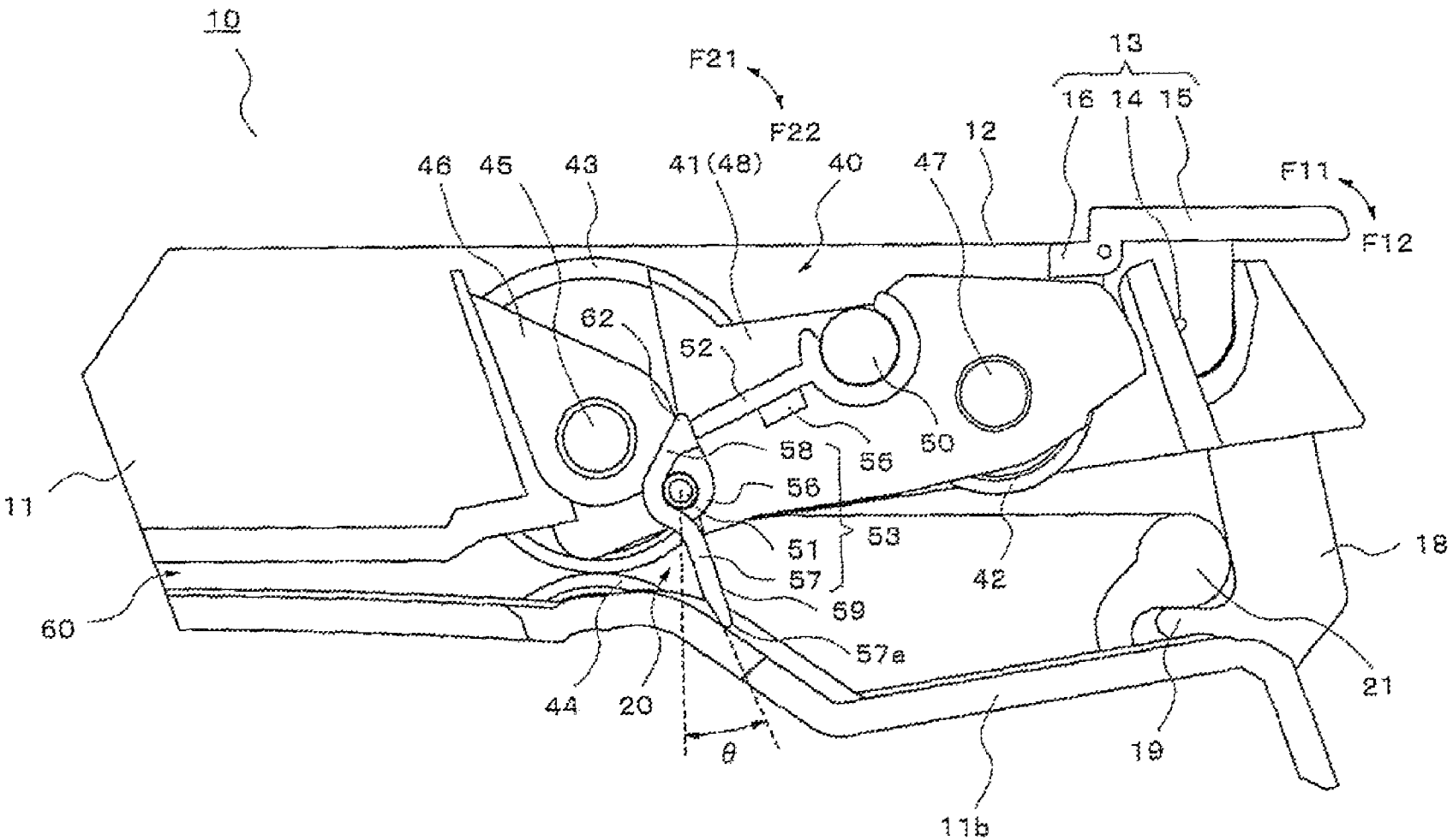
FIG. 2 is a fragmentary sectional view of an automatic document feeder.

An exemplary embodiment of the present invention will be described. FIG. 1 is a fragmentary perspective view of an automatic document feeder 10 according to the exemplary embodiment. FIG. 2 is a fragmentary sectional view of a paper feed section of the automatic document feeder 10. This automatic document feeder 10 can be applied to for example, a facsimile machine, a copier, a printer device, or the like.

The automatic document feeder 10 includes a paper feed section case 11 formed of resin or the like, a cover case 12 for covering the paper feed section case 11, a shutter section 20 for aligning a leading edge of a document P placed on a document tray (not shown), and a paper feed section 40 for supplying the document P whose leading edge is aligned by the shutter section 20 to a conveyance path 60.

A lever 13 for opening and closing the paper feed section case 11 is provided in the paper feed section case 11. The lever 13 has a contact section 16 provided at one end of the lever which makes contact with a case of the paper feed section 40 and a handle section 15 provided at the other end thereof which receives a hand when the paper feed section case 11 is opened or closed. The lever 13 is tilted around a lever shaft 14. Arrows F11 and F12 shown in FIG. 2 indicate a direction in which the lever 13 is tilted.

A lock arm 18 is provided on the lever 13 and a lock claw 19 is provided at the end of the lock arm 18. On the other hand, a claw receiving section 21 for receiving the lock claw 19 is provided in a separation section case 11*b*. When the lever 13 is lifted, the lock arm 18 is rotated in the counterclockwise direction and whereby the lock claw 19 is disengaged from the claw receiving section 21. As a result, the lock of the paper feed section case 11 is released. At that time, the contact section 16 is brought into contact with the paper feed section 40. This action will be described later.

On the other hand, when a hand is released from the lever 13, the lock arm 18 rotates in the clockwise direction and the lock claw 19 is engaged with the claw receiving section 21. Whereby, the paper feed section case 11 is locked.

The paper feed section 40 has a paper feed section holder 41 in the paper feed section case 11. A pickup roller 42, a paper feed roller 43, and the like are disposed in this paper feed section holder 41. A paper feed roller shaft 45 of the paper feed roller 43 is supported by side plates 46 and 48 of the paper feed section case 11 and a shaft 47 of the pickup roller 42 is supported by the side plates of the paper feed section holder 41.

The paper feed section holder 41 is tilted around the paper feed roller shaft 45 of the paper feed roller 43. FIG. 2 shows a standby state in which the paper feed section holder 41 is not tilted. Further, a state in which the paper feed section holder 41 is tilted downward is described as a pick-up state. The paper feed roller 43 and a separation roller 44 are rotationally driven by a motor (not shown) through a reduction gear or the like.

The shutter section 20 has a stopper shaft 50 provided on the side plate of the paper feed section holder 41, a shutter shaft 51 provided in the paper feed section case 11, a stopper 52 which rotates around the stopper shaft 50, a shutter 53 which swings around the shutter shaft 51, and a stopper restricting portion 55 which restricts a position in the counterclockwise direction of the stopper 52.

The stopper 52 is swingably supported by each stopper shaft 50 and the movement of the stopper 52 in the counterclockwise direction is restricted by the stopper restricting portion 55. The stopper restricting portion 55 is attached to the paper feed section case 11 so that a position of the stopper restricting portion 55 does not move when the paper feed section 40 is tilted.

A normal position of the stopper 52 is a position at which the stopper 52 makes contact with the stopper restricting portion 55. In order to position the stopper 52 at the normal position, a spring or the like can be used. However, as mentioned later, when the shutter 53 automatically returns to the standby state by its own weight, the shutter 53 has to temporarily lift the stopper 52 and move the stopper 52 from the normal position. Therefore, a spring force has to be set to a force with which the movement of the shutter 53 is not restricted.

The shutter 53 includes a shaft hole portion 56 in which the shutter shaft 51 is inserted, and a stopper receiving portion 58 and a leading edge restriction portion 57 that are continuously formed and arranged so that the shaft hole portion 56 is positioned therebetween. The position of the center of gravity of the shutter 53 is determined such that the leading edge restriction portion 57 of the shutter 53 hangs down by its own weight when the shutter 53 is assembled by inserting the shutter shaft 51 in the shaft hole portion 56.

In the stopper receiving portion 58 and the leading edge restriction portion 57, a plate surface thereof on a document P side is a restriction surface 59 for restricting the position of the leading edge of the document P. The leading edge restriction portion 57 is arranged so as to have at least an angle $\theta$ in a direction of the document P side relative to the vertical line when the shutter 53 hangs down by its own weight. In this exemplary embodiment, this angle $\theta$ ($\theta>0$) is described as an angle of attack. Meaning of the angle of attack $\theta$ will be described later. The angle of attack $\theta$ cannot be defined uniformly because the angle of attack $\theta$ is determined according to a material, a weight, or the like of the shutter 53.

Figure 3A:
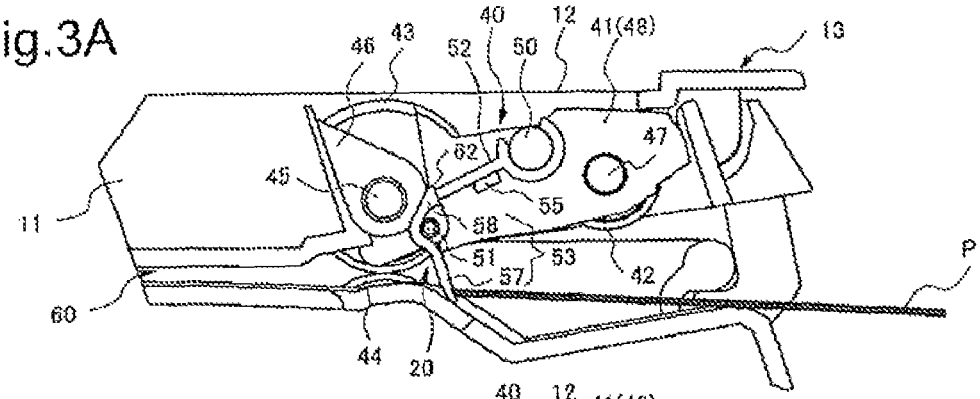
FIG. 3A is a fragmentary sectional view of an automatic document feeder in a standby state.
Figure 3B:
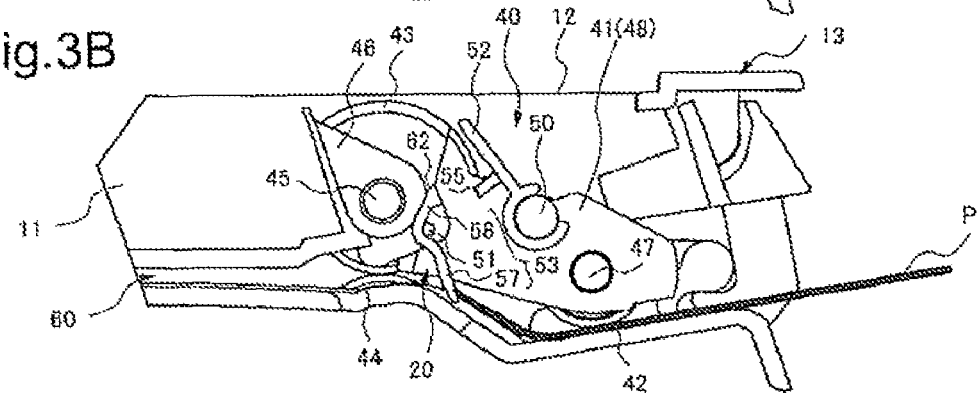
FIG. 3B is a fragmentary sectional view of an automatic document feeder in a pick-up state.
Figure 3C:
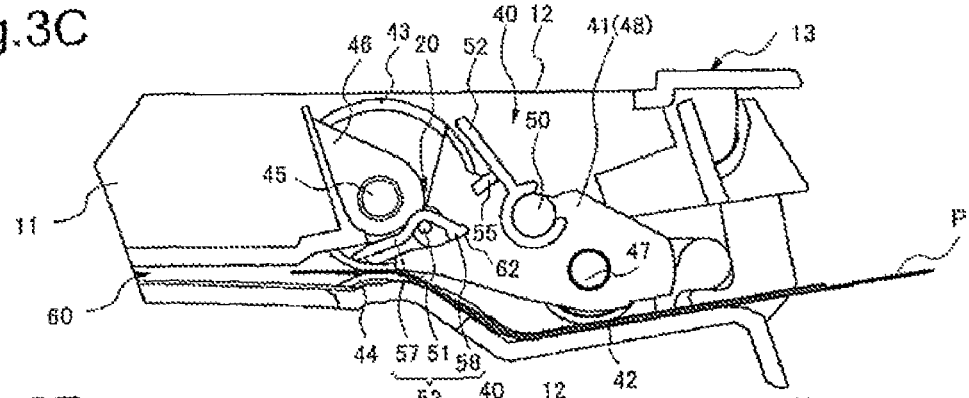
FIG. 3C is a fragmentary sectional view of an automatic document feeder in a paper feeding state.
Figure 3D:
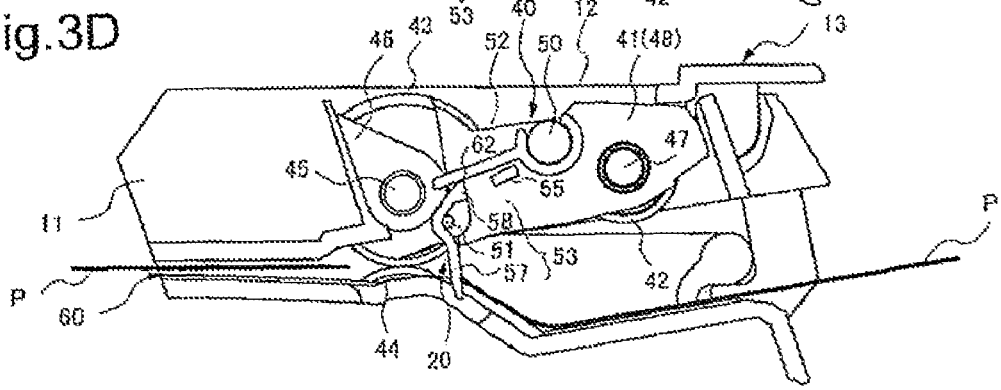
FIG. 3D is a fragmentary sectional view of an automatic document feeder in a return operation state.

A detailed configuration of the paper feed section of such automatic document feeder 10 will be described with reference to FIG. 3A to FIG. 3D. FIG. 3A to FIG. 3D are fragmentary sectional views of the paper feed section in the automatic document feeder 10. FIG. 3A shows a state just before the operation of feeding the document P starts (referred to hereinafter as a standby state). FIG. 3B shows a state in which the document P is picked up (referred to hereinafter as a pick-up state). FIG. 3C shows a state in which the document P is being fed (referred to hereinafter as a paper feeding state). FIG. 3D shows a state in which the operation is returning to the standby state (referred to hereinafter as a return operation state).

As shown in FIG. 3A, the document P placed on the document tray is in contact with the leading edge restriction portion 57. At that time, because the stopper receiving portion 58 of the shutter 53 is in contact with the tip of the stopper 52, the shutter 53 cannot be rotated in the clockwise direction. Accordingly, the document P placed on the document tray makes contact with the shutter 53 and whereby the position of the leading edge of the document P is aligned. Further, when a direction from the pickup roller 42 to the paper feed roller 43 is defined as a paper feed direction, the end portion of the document on the paper feed roller 43 side is called the leading edge of the document.

In such state, when a control section (not shown) starts to control the paper feed operation, the paper feed section 40 is tilted in a direction shown by an arrow F22 in FIG. 2 and the pickup roller 42 pushes the document P downward. When the paper feed section 40 is tilted, the stopper 52 is pushed up with the stopper restricting portion 55 attached in the paper feed section case 11 and whereby the contact of the stopper receiving portion 58 and the stopper 52 is released as shown in FIG. 3B.

After that, when a motor (not shown) is operated and the paper feed roller 43, the pickup roller 42, and the like are rotated, the pickup roller 42 picks up the document P in a direction of the conveyance path 60 (left side in FIG. 3 and other figures). At that time, because the contact of the stopper receiving portion 58 and the stopper 52 has already been released, the shutter 53 can be rotated in both clockwise and counterclockwise directions as shown in FIG. 3C. Accordingly, the document P picked up by the pickup roller 42 is fed in the conveyance path 60 while pushing the leading edge restriction portion 57 of the shutter 53. Namely, the shutter 53 is rotated in the clockwise direction.

When the leading edge of the document P reaches a nip portion between the paper feed roller 43 and the separation roller 44, a separation process is performed by the paper feed roller 43 and the separation roller 44 in order to prevent a plurality of documents P from being fed in the conveyance path 60. In the separation process, for example, a method with which the separation roller 44 and the paper feed roller 43 are rotated in the clockwise direction to feed back the document located on the separation roller 44 side is used. Thus, by performing the separation process, only one document P is fed in the conveyance path 60.

When the document P reaches the paper feed roller 43, the paper feed section 40 returns to the standby state shown in FIG. 3A from the tilted state in order to prevent the operation of the paper feed roller 43 and the separation roller 44 from being interrupted and whereby the pickup roller 42 is spaced from the document P. In the automatic document feeder disclosed in Japanese Patent Application Laid-Open No. 2005-126202, when the pick-up arm 107 returns to the standby state, the conveyance path is blocked by the shutter 109 and whereby the above-mentioned operation can not be performed. Therefore, a paper has to be fed one by one or a state in which the pickup roller always feeds the successive document occurs. This means that the disclosed automatic document feeder can not actually be used. After the trailing edge of the last document P fed in the conveyance path 60 by the paper feed roller 43 has passed at a position at which the shutter 53 is disposed, the shutter 53 hangs down by its own weight as shown in FIG. 3D.

Because the paper feed section 40 has already returned to the standby state, the shutter 53 hangs down by its own weight and a tip 62 of the stopper receiving portion 58 makes contact with the stopper 52. However, in a state in which the tip 62 of the stopper receiving portion 58 is in contact with the stopper 52, a potential energy of the shutter 53 has not reached a minimum point. For this reason, the shutter 53 rotates so that the potential energy thereof becomes minimum while the stopper receiving portion 58 pushes up the stopper 52. When the tip 62 of the stopper receiving portion 58 is spaced from the stopper 52 and the shutter 53 returns to the standby state shown in FIG. 3A, the potential energy of the shutter 53 becomes minimum and the shutter 53 stops. The pickup process and the paper feeding process for the document P are completed.

There is a possibility that the document P is jammed during such operation. In such case, the lock claw 19 is disengaged from the claw receiving section 21 by holding the lever 13 and tilting it in a direction of the arrow F11 shown in FIG. 2. By this, the paper feed section case 11 can be opened. Because the paper feed section 40 is connected to the paper feed section case 11, the document jammed when performing the paper feeding process, the paper conveying process, or the like can be exposed by opening the paper feed section case 11. The user removes the jammed document and closes the paper feed section case 11.

Figure 4:
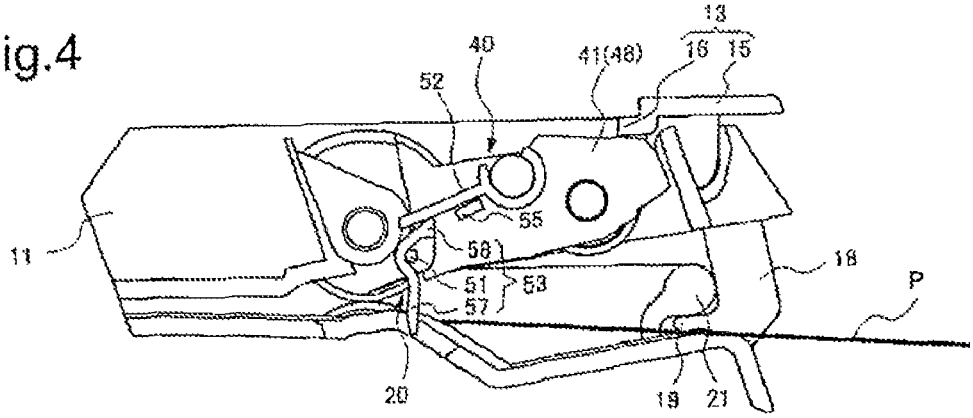
FIG. 4 is a fragmentary sectional view of an automatic document feeder which shows a case as an example in which a shutter can not return to a standby state because the shutter stops during the operation.

By the way, there is a possibility that for example, the dust or the like enters between the shutter shaft 51 and the stopper shaft 50 and whereby the shutter 53 or the stopper 52 can not rotate smoothly. In such case, it may become difficult for the shutter 53 to return to the standby state shown in FIG. 3A from the return operation state shown in FIG. 3D. Namely, there is a possibility that when the dust or the like falls onto the shutter shaft 51, operation of the shutter 53 is interrupted and the shutter 53 can not return to the standby state. Additionally, there is a possibility that when the dust falls onto the stopper shaft 50, the return operation of the shutter 53 is blocked and whereby operation of the shutter 53 is interrupted and the shutter 53 can not return to the standby state. FIG. 4 shows a case in which operation of the shutter 53 is interrupted and the shutter 53 can not return to the standby state. In such case, because the position of the leading edge of the document P cannot be aligned, it causes a paper jam or the like when the document P is conveyed.

Figure 5:
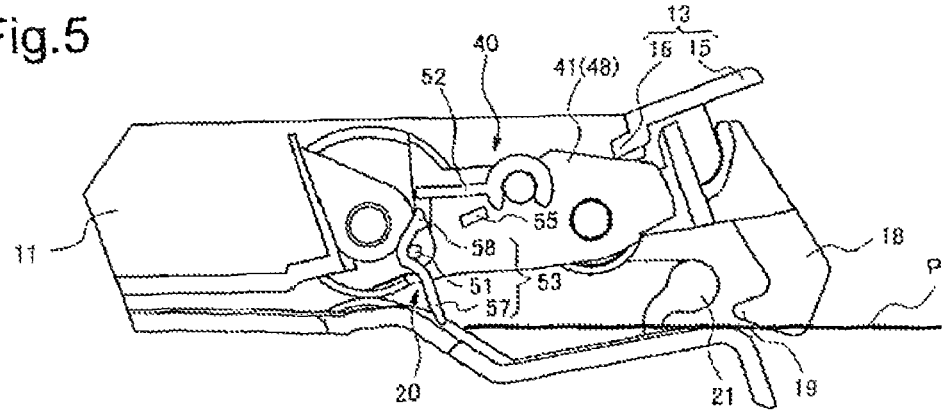
FIG. 5 is a fragmentary sectional view of an automatic document feeder in a state in which a cover case is being opened.

However, in the exemplary embodiment, when the cover case 12 is opened by lifting the lever 13 in order to remove the jammed document, the shutter 53 can be made return to a standby position even when the dust or the like enters between the shutter shaft 51 and the stopper shaft 50. Namely, as shown in FIG. 5, when the lever 13 is lifted, the contact section 16 is brought into contact with the paper feed section 40 and whereby the paper feed section 40 is tilted. When the paper feed section 40 is tilted, the stopper 52 is rotated in the clockwise and whereby the dust or the like which has fallen onto the stopper shaft 50 or the like can be easily discharged.

Because the stopper shaft 50 can be rotated a very small amount in the clockwise, the contact of the stopper 52 and the stopper receiving portion 58 is released. Accordingly, the shutter 53 will be in a free state in which the shutter 53 does not receive a force from the stopper 52 and can easily return to the standby state. The dust or the like which has fallen onto the shutter shaft 51 can be easily discharged by this operation.

Figure 6:
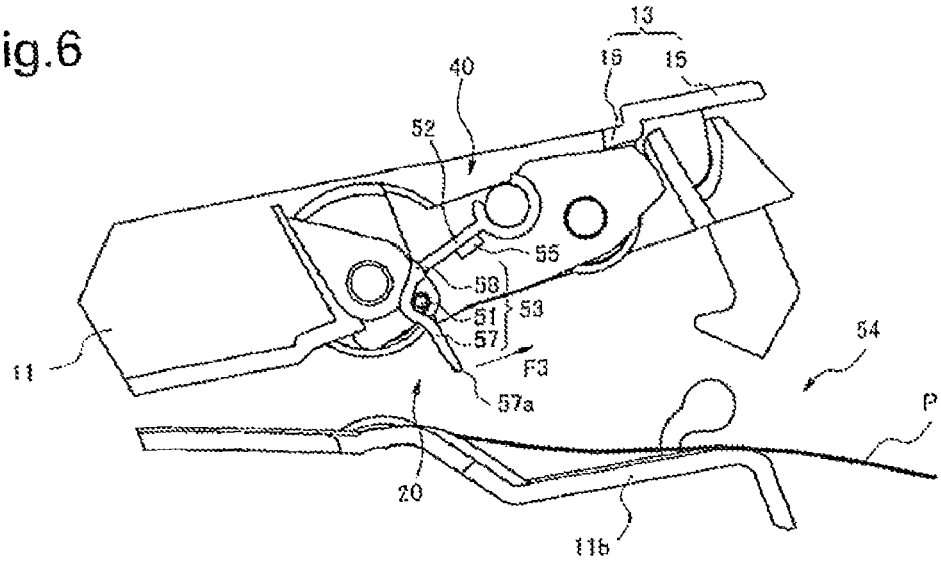
FIG. 6 is a fragmentary sectional view of an automatic document feeder in a state in which a cover case has been opened.
Figure 7A:
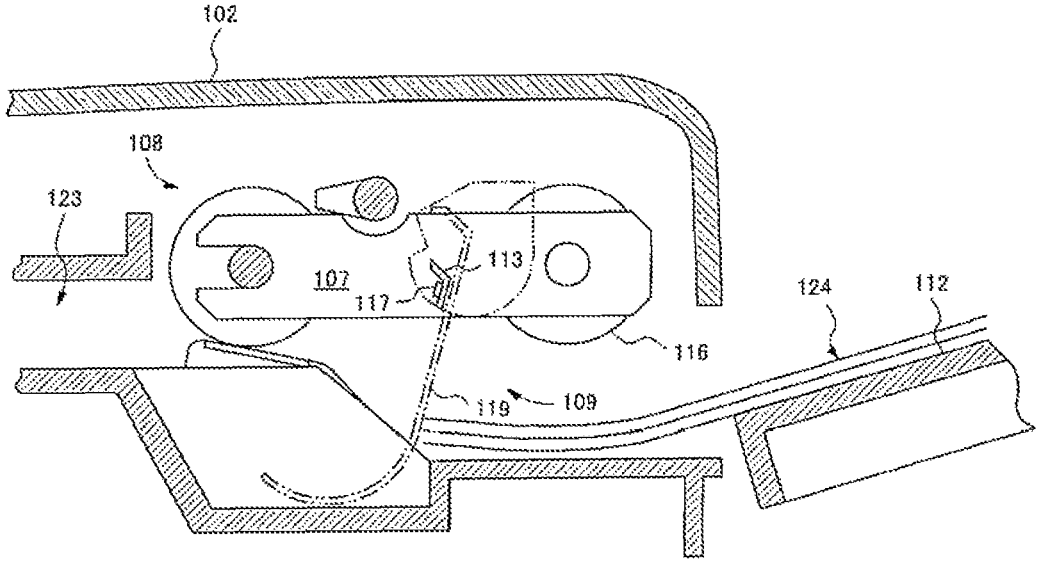
FIG. 7A is a fragmentary sectional view of an automatic document feeder according to the related technology in a standby state just before the automatic feeding of the document starts.
Figure 7B:
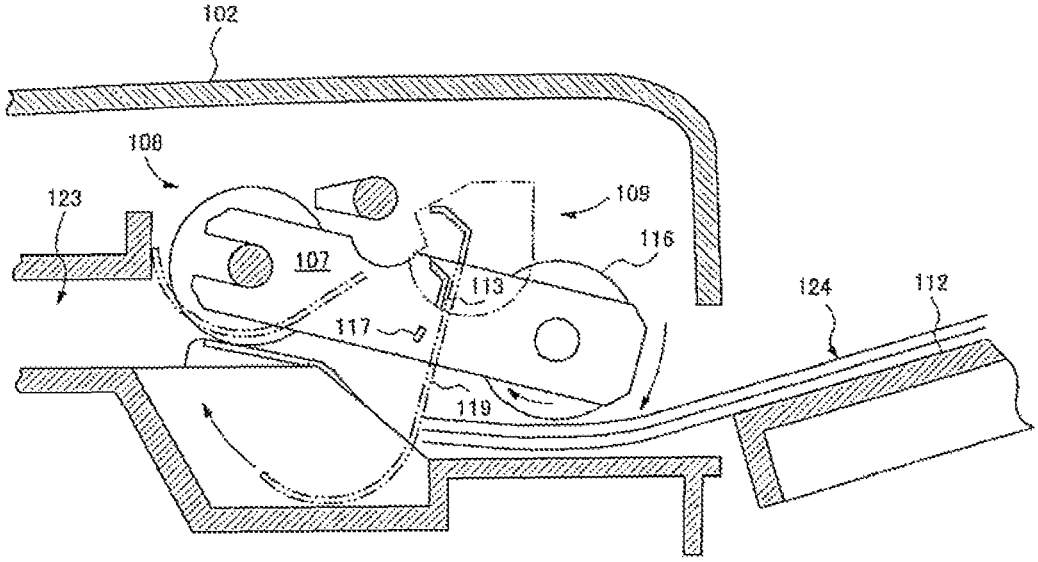
FIG. 7B is a fragmentary sectional view of an automatic document feeder according to the related technology in a pick-up state in which a document is picked up.

When the paper feed section case 11 is closed, the shutter 53 is in the standby state. At that time, there is a possibility that the document P has not been completely taken out or the document left in the document tray is moved forward slightly to the paper feed roller 43 side. FIG. 6 shows a case in which the document is moved forward slightly to the paper feed roller 43 side. In such state, there is a risk in which when the paper feed section case 11 is closed, a tip 57*a* of the shutter 53 which has returned to the standby state makes contact with the document P and whereby the document P is cut through by the leading edge restriction portion 57 or another damage occurs.

However, as described above, because the leading edge restriction portion 57 is formed so as to have the angle of attack θ and the tip 57*a* of the leading edge restriction portion 57 is formed in a smooth circular arc shape, the shutter 53 is rotated in a direction of an arrow F3 shown in FIG. 6 by a force generated when the document is brought into contact with the leading edge restriction portion 57. Accordingly, the document can be prevented from being damaged by the leading edge restriction portion 57.

In particular, as shown in FIG. 6, a surface of the separation section case 11*b* inclines to a paper feeding inlet 54 side at a position under the leading edge restriction portion 57. For this reason, the document P is bent in a concave shape appropriately. It is clear that when the document P that is bent in such shape is brought into contact with the leading edge restriction portion 57 and the shutter 53 is rotated by its contact force, it can be most efficiently rotated in a direction of the arrow F3.

Figure 8A:
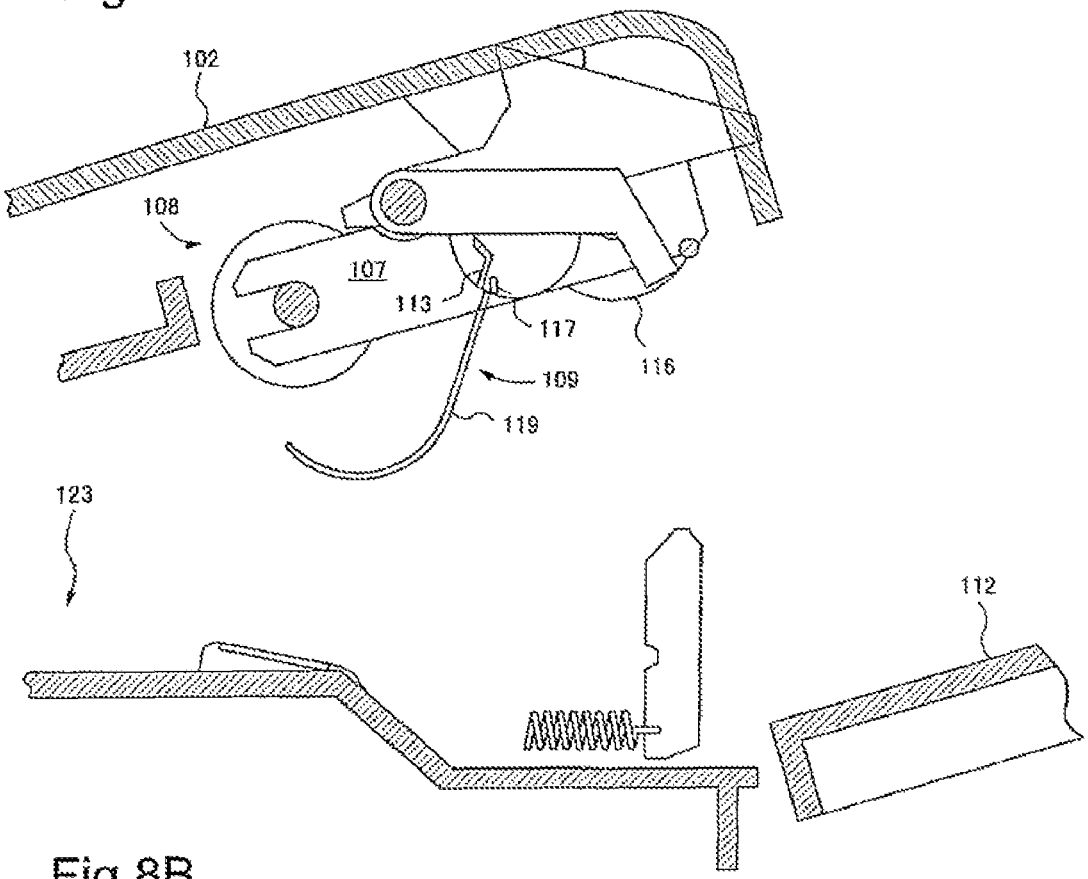
FIG. 8A is a fragmentary sectional view of an automatic document feeder according to the related technology in a cover open state.
Figure 8B:
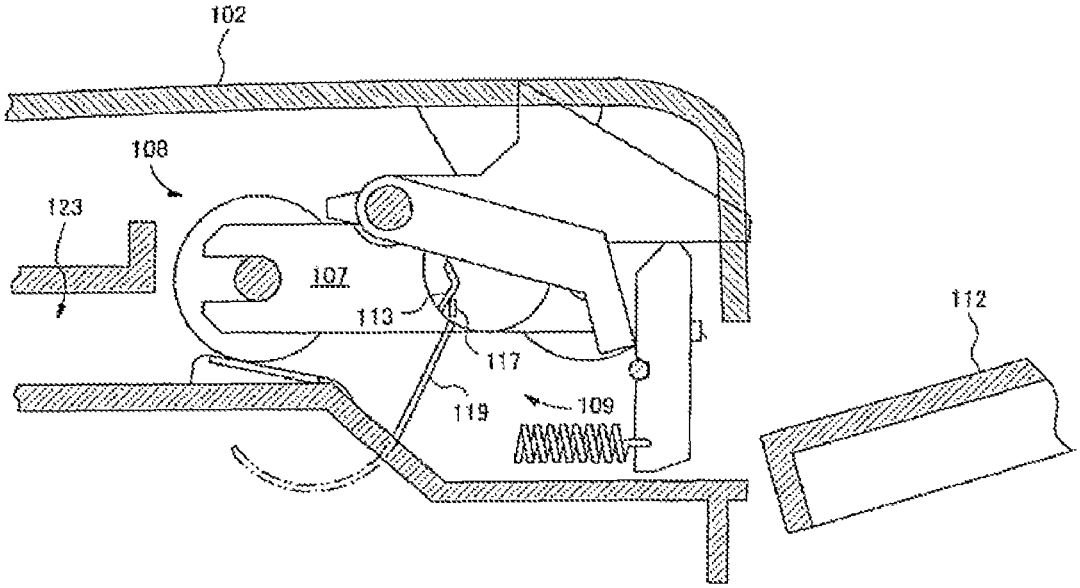
FIG. 8B is a fragmentary sectional view of an automatic document feeder according to the related technology in a cover close state.

In contrast, in the above-mentioned automatic document feeder disclosed in Japanese Patent Application Laid-Open No. 2005-126202, for example, in FIG. 8B, the shutter 119 rotates in the clockwise direction because the rotation of the shutter 119 in the counterclockwise direction is restricted by the receiving portion 113. This clockwise direction is a direction in which the shutter 119 is rotated as if the shutter 119 climbs the inclined surface. Therefore, there is a high possibility that the document is damaged by the shutter 119.

However, in this exemplary embodiment, because the leading edge restriction portion 57 is rotated as if it climbs the inclined surface, a risk in which the document is damaged by the shutter 119 becomes very small. Namely, the document is hardly damaged.

Thus, because no electrical components are used at all for the operation of the shutter section, the automatic document feeder can be produced at low cost. Because all the operation of the shutter section is performed by the shutter's own weight that is an attribute thereof, all the operation can be surely performed. Accordingly, the control and the operation for changing the position of the stopper and the receiving portion that are required for removing the jammed document or the like in the automatic document feeder disclosed in Japanese Patent Application Laid-Open No. 2005-126202 are not required in the automatic document feeder according to the present invention and reliability thereof is improved.

Further, in the above-mentioned description, a claw engagement system is employed as a system to engage the paper feed section case with the separation section case. However, another publicly known system such as a sliding system or the like can be applied.

Further, in the above-mentioned description, the structure in which the shutter and the stopper are rotated is used. However, another structure in which a cylinder, a crank, a cam, and the like are used may be adopted.

The previous description of embodiments is provided to enable a person skilled in the art to make and use the present invention. Moreover, various modifications to these exemplary embodiments will be readily apparent to those skilled in the art, and the generic principles and specific examples defined herein may be applied to other embodiments without the use of inventive faculty. Therefore, the present invention is not intended to be limited to the exemplary embodiments described herein but is to be accorded the widest scope as defined by the limitations of the claims and equivalents. Further, it is noted that the inventor's intent is to retain all equivalents of the claimed invention even if the claims are amended during prosecution.

The invention claimed is:

1. An automatic document feeder for automatically feeding a document placed on a document tray comprising:

a paper feed section which includes at least a paper feed roller and a pickup roller and is tilted up and down around a roller shaft of the paper feed roller;

a shutter section including a shutter which is provided on a side plate of the paper feed section, placed at a document restriction position at which a position of a leading edge of the document is restricted before the paper feed section picks up the document, tilted by being pushed by the document to be picked up when the paper feed section picks up the document, and automatically returns to the document restriction position by its own weight after the picked up document has passed under the shutter, wherein the shutter section further comprises:

a stopper which restricts the tilting movement of the shutter in a paper feed direction so that the position of the leading edge of the document is aligned when the document before being fed is brought into contact with the shutter, releases the restriction to the shutter so that the shutter can be tilted in the paper feed direction by the document to be fed when the document is fed, and is pushed up by the shutter inclined in the paper feed direction to make the shutter automatically return to the document restriction position after the document has been fed; and a lever which has a contact section that is provided at one end of the lever and makes contact with a case of the paper feed section and a handle section that is provided at the other end thereof and held by a hand and is tilted around a lever shaft provided between the contact section and the handle section, wherein when the handle section is lifted, the paper feed section is tilted by the contact section and whereby the stopper is disengaged from the shutter.

2. The automatic document feeder described in claim 1, wherein the shutter section further comprises a stopper restricting portion which is connected to a case of an automatic document feeder main body and releases the restriction to the shutter by the stopper by disengaging the stopper from the shutter when the paper feed section is tilted in a direction in which the pickup roller is brought into contact with the document.

3. The automatic document feeder described in claim 1, wherein a tip of the shutter has a predetermined angle relative to the vertical line when the shutter is located at the document restriction position.

4. The automatic document feeder described in claim 3, wherein the tip of the shutter is formed in an approximately circular arc shape.

* * * * *